US008517746B2

(12) United States Patent
Manickam

(10) Patent No.: US 8,517,746 B2
(45) Date of Patent: Aug. 27, 2013

(54) CARD EDGE CONNECTOR

(75) Inventor: Venkatesan Manickam, Singapore (SG)

(73) Assignee: Molex Incorporated, Lisle, IL (US)

( * ) Notice: Subject to any disclaimer, the term of this patent is extended or adjusted under 35 U.S.C. 154(b) by 55 days.

(21) Appl. No.: 13/345,340

(22) Filed: Jan. 6, 2012

(65) Prior Publication Data

US 2012/0178274 A1 Jul. 12, 2012

(30) Foreign Application Priority Data

Jan. 7, 2011 (CN) ..... 2011 2 0006777

(51) Int. Cl.
*H01R 13/62* (2006.01)

(52) U.S. Cl.
USPC ..... 439/160

(58) Field of Classification Search
USPC ..... 439/160, 159
See application file for complete search history.

(56) References Cited

U.S. PATENT DOCUMENTS

| | | | | |
|---|---|---|---|---|
| 5,413,497 | A * | 5/1995 | Lwee | 439/328 |
| 5,997,331 | A * | 12/1999 | Tu | 439/328 |
| 7,048,565 | B2 * | 5/2006 | Lin | 439/326 |
| 7,074,067 | B2 * | 7/2006 | Yang et al. | 439/326 |
| 7,510,415 | B2 * | 3/2009 | Wang | 439/159 |
| 7,677,907 | B2 * | 3/2010 | Guan et al. | 439/157 |
| 7,938,657 | B2 * | 5/2011 | Tang et al. | 439/160 |

* cited by examiner

*Primary Examiner* — Gary F. Paumen
(74) *Attorney, Agent, or Firm* — Stephen L. Sheldon

(57) ABSTRACT

A card edge connector comprises an body, a plurality of terminals received into the body, and at least one card-ejecting member installed on the body. The body comprises a base portion having an insertion slot and an installation portion disposed on at least one end of the base portion. The card-ejecting member comprises a pivotable main body disposed on the installation portion, an ejecting portion disposed on the lower end of the main body and opposing the bottom of the insertion slot, and a metal reinforcing member; the metal reinforcing member is disposed on the ejecting portion of the card-ejecting member.

10 Claims, 10 Drawing Sheets

CARD EDGE CONNECTOR

RELATED APPLICATIONS

This application claims priority to Chinese Application No. 201120006777.0, filed Jan. 7, 2011, which is incorporated herein by reference in its entirety.

TECHNICAL FIELD

The present invention relates to a card edge connector, in particular to a card edge connector having a card-ejecting member with high bearing capacity.

DESCRIPTION OF THE RELATED ART

FIG. 1 shows a commonly seen card edge connector 8, which is used to connect a memory module card or an expansion card 9. The card edge connector 8 has a slender electrically insulative body 80, a plurality of terminals 81, and a pair of card-ejecting members 82. The electrically insulative body 80 comprises an abutting-connection slot 800 and a plurality of terminal receiving slots 801 for an electronic card 9 to be inserted in. Each terminal 81 is received into a corresponding terminal receiving slot 801. A pair of arms 83 extends upwardly from two ends of the electrically insulative body 80, each arm 83 having a receiving space (not shown) open to the abutting-connection slot 800. Each card-ejecting member 82 comprises a main body 820, an ejecting portion 821, an operating portion 822 and a locking portion 823. The main body 820 is received in the receiving space, two pivots 824 are formed on the outer surface of the two opposing sidewalls thereof, and a corresponding pivoting hole (not shown) is formed on the arm 83 for receiving the pivot 824. The ejecting portion 821 protrudes inwardly from the bottom of the main body 820. The operating portion 822 and the locking portion 823 are disposed on the top of the main body 820.

When the card edge connector 8 is in a release state, the ejecting portion 821 of the card-ejecting member 82 protrudes obliquely into the abutting-connection slot 800. When an electronic card 9 is inserted into the abutting-connection slot 800 of the electrically insulative body 80, therefore, its abutting-connection end 90 pushes the ejecting portion 821 of the card-ejecting member 82 such that the card-ejecting member 82 gradually turns to being relatively vertical from being oblique until the locking portion 823 is received into the notch 911 on the locking edge 91 of the electronic card 9. At this moment, the card edge connector 8 changes from the release state to the locking state. Press the operating portion 822 to trigger the card-ejecting member 82 such that the locking portion 823 of each card-ejecting member 82 disengages from the notch 911 on the electronic card 9, further rotates outwardly from the locking position to the release position around the pivot 824, wherein the ejecting portion 821 pushes the abutting-connection end 90 of the electronic card 9 to disengage from the abutting-connection slot 800.

In order to support the trend of smaller electronics, however, suggests that the card edge connector 8 should also be reduced in size. Unfortunately, such size reduction requires that the thickness of the ejecting portion 821 of the card-ejecting member 82 becomes reduced, leading to sharp decline of the bearing capacity of the card-ejecting member 82. In practical applications, the ejecting portion 821 may break due to insufficient bearing capacity, which in turn impacts the quality stability and service life of the entire card edge connector 8. Consequentially, certain individuals would appreciate an improved edge card connector that could be reduced in size while still providing acceptable reliability.

SUMMARY OF THE INVENTION

A card edge connector comprises an body, a plurality of terminals received into the body, and at least one card-ejecting member installed on the body. The body comprises a base portion having an insertion slot and an installation portion disposed on at least one end of the base portion. The card-ejecting member comprises a pivotable main body disposed on the installation portion, an ejecting portion disposed on the lower end of the main body and opposing the bottom of the insertion slot, and a metal reinforcing member; the metal reinforcing member is disposed on the ejecting portion of the card-ejecting member.

In an embodiment, the metal reinforcing member comprises a reinforcing portion covering the top surface of the ejecting portion. The reinforcing portion has a round and smooth curved portion on the end thereof facing the insertion slot. The metal reinforcing member further comprises a fixing portion connected to the reinforcing portion and the fixing portion is fixedly held to the main body. The main body further comprises two opposing sidewalls and an open slot formed between the two opposing sidewalls, the fixing portion further comprises extension portions that extend from two sides of the reinforcing portion and a first fixing portion and a second fixing portion that are connected to each extension portion, respectively, and extend in a wing shape; the first fixing portion and the second fixing portion are fixed onto the two opposing sidewalls of the main body, respectively. Insertion slots are formed on the inner sides of the two opposing sidewalls of the main body that are corresponding to the first fixing portion and the second fixing portion with the two extension portions disposed on the inner sides of the sidewalls, respectively. At least one of the first fixing portion and the second fixing portion is provided with a barb for interference fit with corresponding insertion slots. At least one of the first fixing portion and the second fixing portion is provided with a lug for fixing with a corresponding insertion slot. The installation portion is provided with a receiving space open to the insertion slot, the two opposing sidewalls of the main body are provided, respectively, with a pivot, and the two opposing sidewalls of the receiving space are provided, respectively, with a pivoting hole for receiving corresponding pivot. The card-ejecting member is provided with a locking portion on the top end of the main body relative to the ejecting portion and further provided with an operating portion at the end extended with the locking portion.

DETAILED DESCRIPTION OF THE PREFERRED EMBODIMENTS

To better understand the spirit of the disclosure, it will be further described below with reference to preferred embodiments. It should be noted that one benefit is the ability to provide a card edge connectors that has a card-ejecting member with a high bearing capacity but remains robust even when miniaturized.

Figure 2:
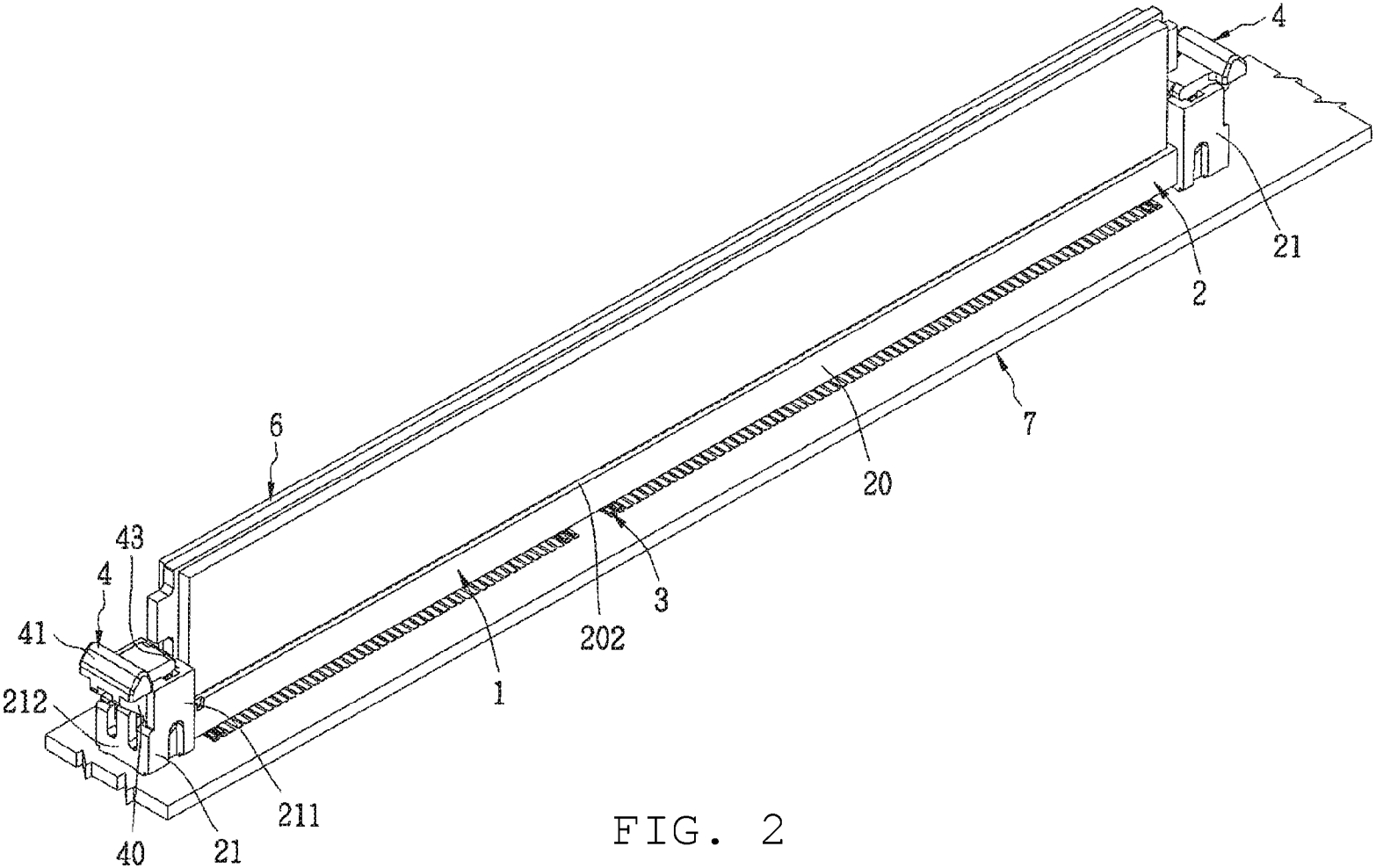
FIG. 2 is a three dimensional view of an embodiment of the card edge connector locking with a matching electronic card.
Figure 3:
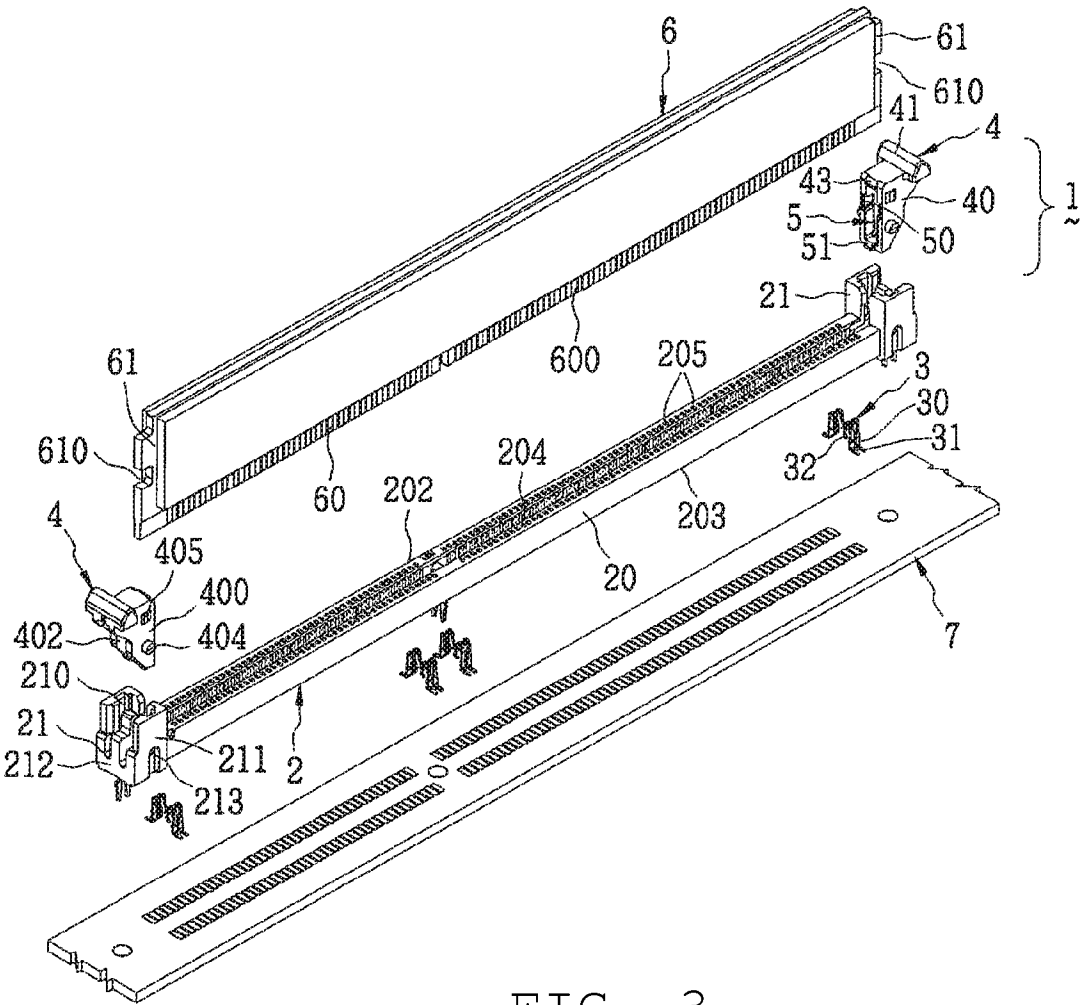
FIG. 3 is a three dimensional exploded view of an embodiment of the card edge connector and a matching electronic card.
Figure 4:
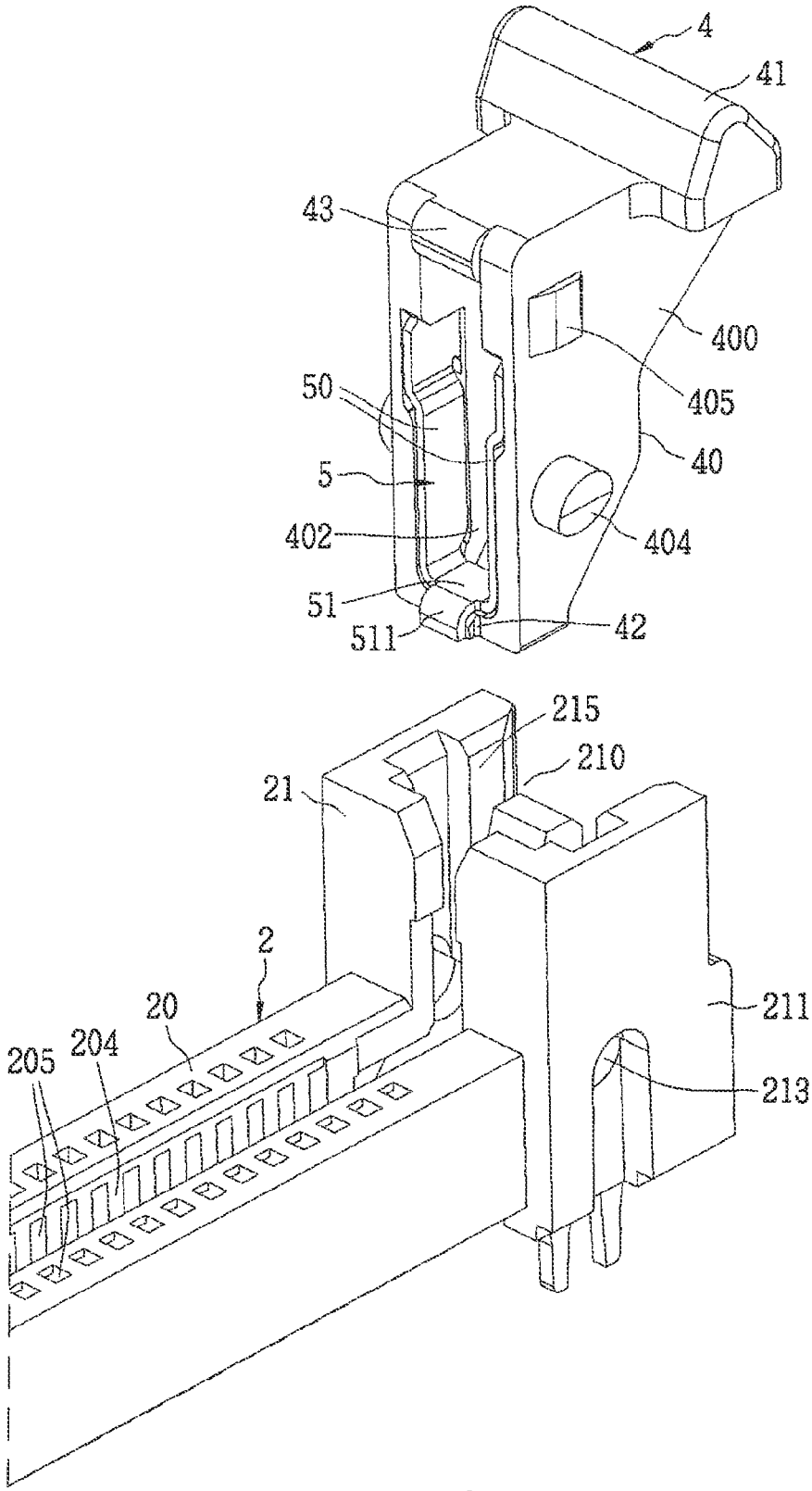
FIG. 4 is a partial three dimensional exploded view of an embodiment of the card edge connector.

As shown in FIG. 2, a card edge connector 1 comprises a body 2 (which can be formed of an electrically insulative material), a plurality of terminals 3 received into the body 2, and a pair of card-ejecting members 4. The card edge connector 1 is for an electronic card 6 (a memory module card in this embodiment) to be inserted along the insertion direction (from up down in the figure) and locked in a locking position shown in the figure, thereby realizing electrical connection between the electronic card 6 and the circuit board 7.

As shown in FIGS. 3-6, the body 2 comprises a slender base portion 20 and a pair of installation portions 21 protruding from two corresponding ends of the base portion 20. The base portion 20 comprises an abutting-connection face 202 facing the electronic card 6 and an installation face 203 opposing the abutting-connection face 202 and facing the circuit board 7. An insertion slot 204 is formed on the base portion 20 that opens to the abutting-connection face 202, and a plurality of terminal installation slots 205 are formed on the opposing inner sidewalls of the insertion slot 204. The plurality of terminals 3 are received into corresponding terminal installation slots 205. Each installation portion 21 is provided with a receiving space 210 open to the insertion slot 204. The receiving space 210 has two opposing sidewalls 211 that are parallel to the insertion slot 204, and an outer sidewall 212 that is relatively far away from the insertion slot 204. The two opposing sidewalls 211 are provided, respectively, with a pivoting hole 213. Two stop portions 215 are disposed, respectively, on the inner sides of the two opposing sidewalls 211 of the receiving space 210, and connected, respectively, between the outer sidewall 212 and corresponding sidewall 211 to prevent the card-ejecting member 4 from random turning between the card ejecting position and the card locking position.

Each terminal 3 comprises a fixing portion 30 installed in the terminal installation slot 205 through interference fit. A welding portion 31 extends downwardly from one end of the fixing portion 30 out of the insertion slot 204, and a U-shaped contact portion 32 extending upwardly from the other end of the fixing portion 30 and folding down with the opening thereof slightly facing downward, the contact portion 32 protruding inside the insertion slot 204.

Figure 5:
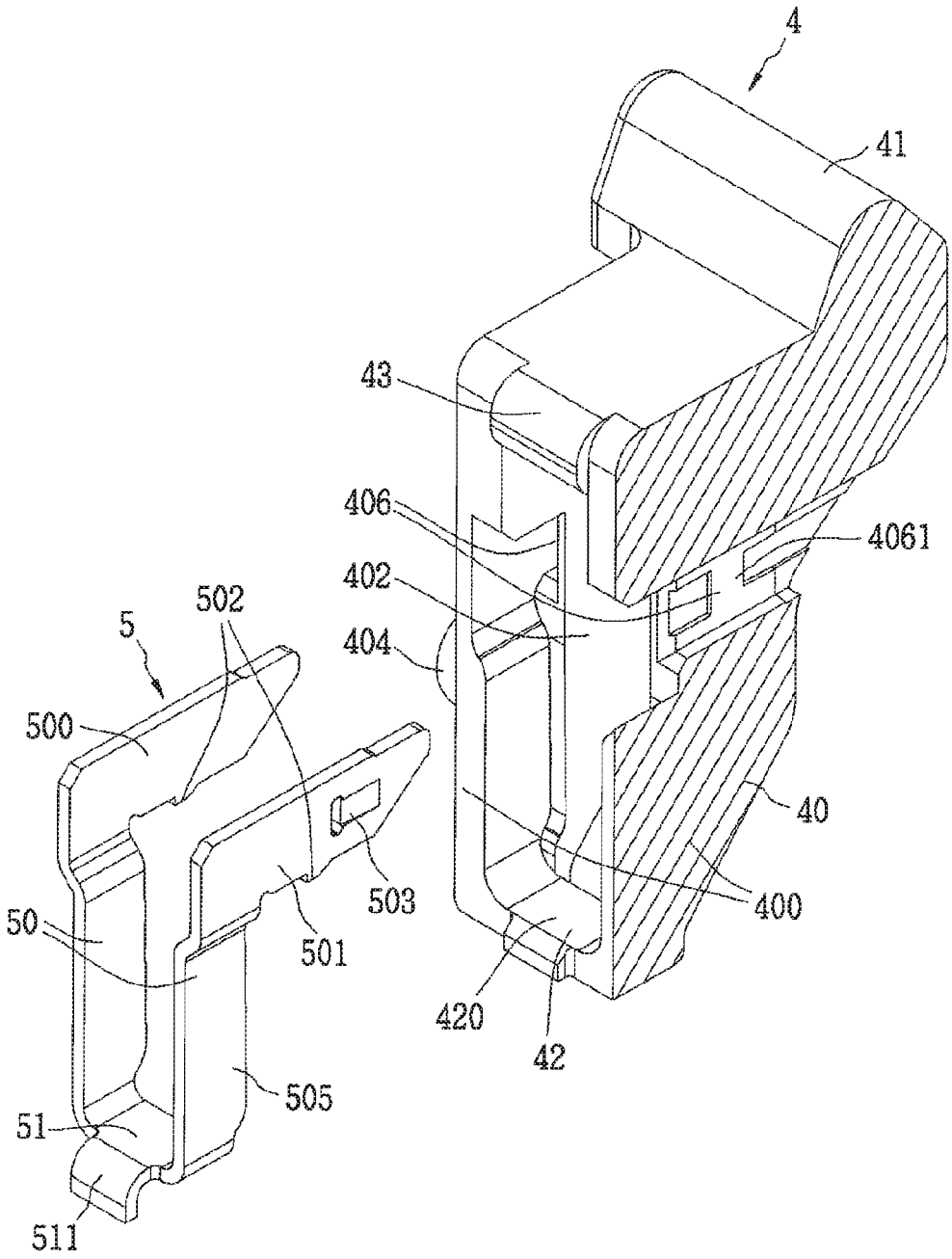
FIG. 5 is a three dimensional view of an embodiment of the card-ejecting member and the metal reinforcing member of the card edge connector; wherein the card-ejecting member 4 is partially cut away to show the structure of the insertion slot 406.
Figure 6:
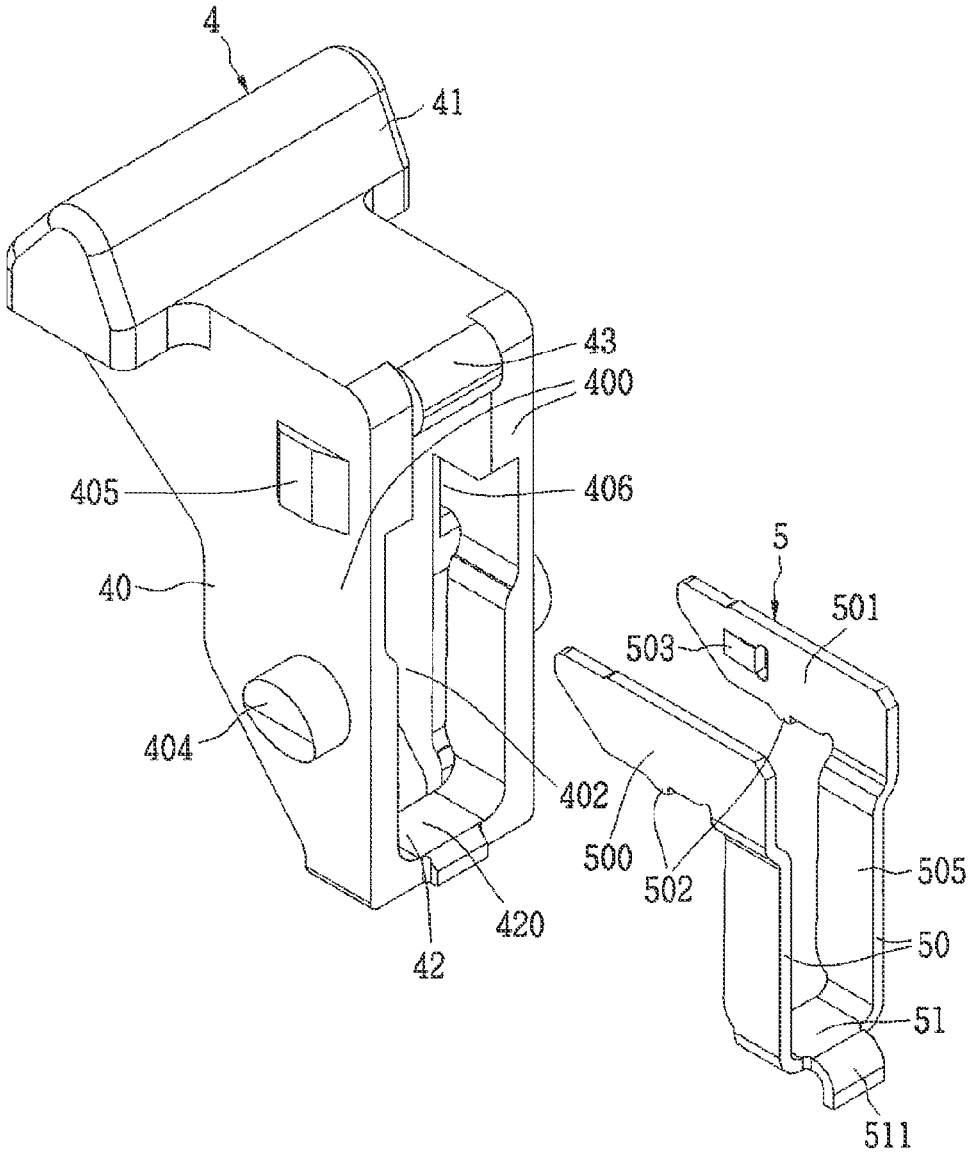
FIG. 6 is a three dimensional view from a different angle of an embodiment of the card-ejecting member and the metal reinforcing member of the card edge connector.

Each card-ejecting member 4 comprises a main body 40, an operating portion 41, an ejecting portion 42 disposed on the lower end of the main body 40 and opposing the bottom of the insertion slot 204, and a locking portion 43 disposed on the upper end of the main body 40. The main body 40 is constructed to be pivotable and move in the receiving space 210 of the installation portion 21, which comprises two opposing sidewalls 400 and an open slot 402 formed between the two opposing sidewalls 400. The outer surface of each sidewall 400 comprises a pivot 404 that is corresponding to the pivoting hole 213 on the installation portion 21, and a fixed convex part 405 disposed corresponding to the stop portion 215. An insertion slot 406 is disposed, respectively, on the inner side of each sidewall 400. The card-ejecting member 4 as shown in FIG. 5 is partially cut away to show the structure of the insertion slot 406. The operating portion 41 protrudes from the outer side of the upper end of the main body 40. By pressing the operating portion 41, the corresponding card ejecting member 4 rotates between a card locking position and a card ejecting position around the pivot 404 that is pivotedly connected inside the pivoting hole 213. The ejecting portion 42 protrudes from the lower portion of the main body 40 to the side of the insertion slot 204. The locking portion 43 is connected to the two sidewalls 400 thereof at the upper end of the main body 40.

The card edge connector 1 further comprises a metal reinforcing member 5 for reinforcing the card-ejecting member 4's bearing capacity. The metal reinforcing member 5 is disposed at least on the ejecting portion 42 of the card-ejecting member 4. In a preferred embodiment, the metal reinforcing member 5 comprises a fixing portion 50 and a reinforcing portion 51 that is connected with the fixing portion 50. The fixing portion 50 further comprises extension portions 505 that extend upwardly from two sides of the reinforcing portion 51 and a first fixing portion 500 and a second fixing portion 501 that are connected to each extension portion 505, respectively, and extend in a wing shape. The first fixing portion 500 and the second fixing portion 501 are inserted, respectively, into the insertion slots 406 on the opposing sidewalls 400 of the main body 40 on the card-ejecting member 4, while the two extension portions 505 are disposed, respectively, on the inner sides of the sidewalls 400. The first fixing portion 500 and the second fixing portion 501 are provided with barbs 502, while the second fixing portion 501 is provided with an inwardly projecting lug 503. The barbs 502 interfere, respectively, with the inner walls of corresponding insertion slots 406, while the lug 503 locks against the backside of the stop portion 4061 on the inner walls of the insertion slots 406 such that the first fixing portion 500 and the second fixing portion 501 are fixed to the main body 40. The reinforcing portion 51 covers the top surface 420 of the ejecting portion 42, preferably, the reinforcing portion 51 has a round and smooth curved portion 511 on the end thereof facing the insertion slot 204 for smoother operations when ejecting a card.

The electronic card 6 for connecting with the card edge connector 1 comprises an abutting-connection portion 60 disposed on the bottom thereof and two locking sides 61 opposing to each other on the left and right. The electronic card 6 includes a row of contact pads 600 that are disposed on the two opposing surfaces of the abutting-connection portion 60, respectively, for an abutting connection with the card edge connector 1, and each locking side 61 has a locking notch 610.

Figure 7:
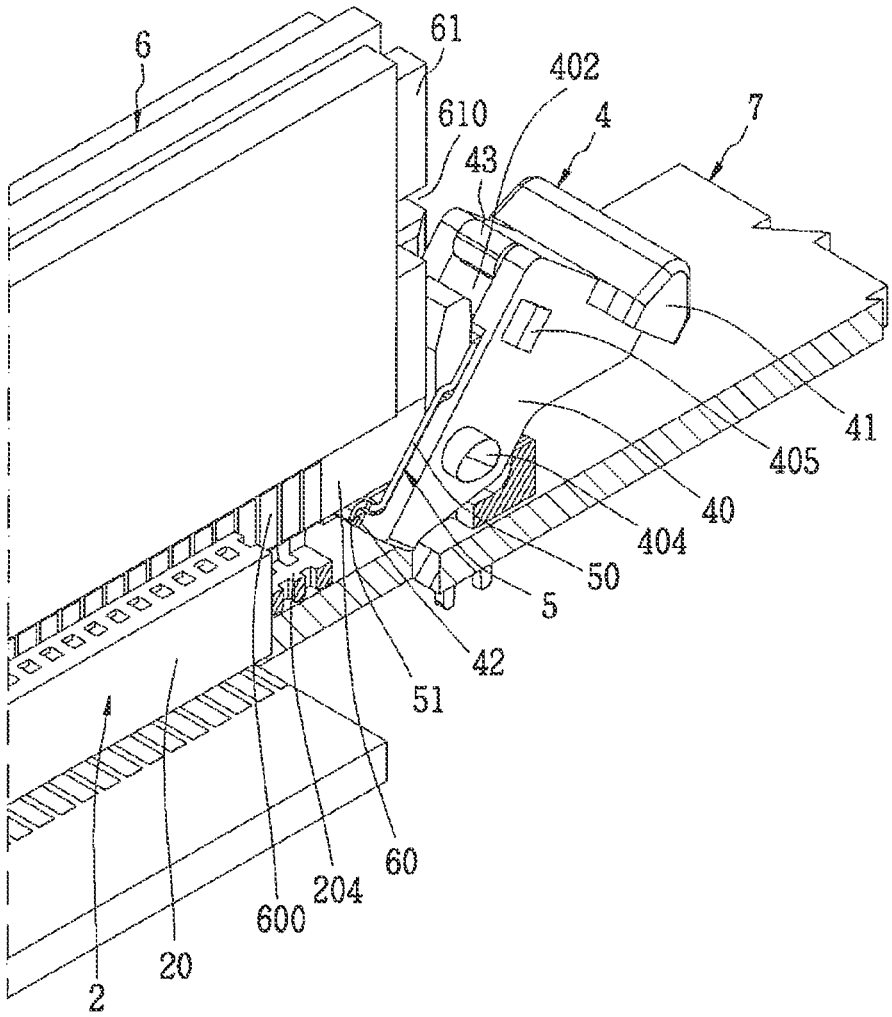
FIG. 7 is a partially cutaway three dimensional view of an embodiment of the card edge connector in the card ejecting position.
Figure 8:
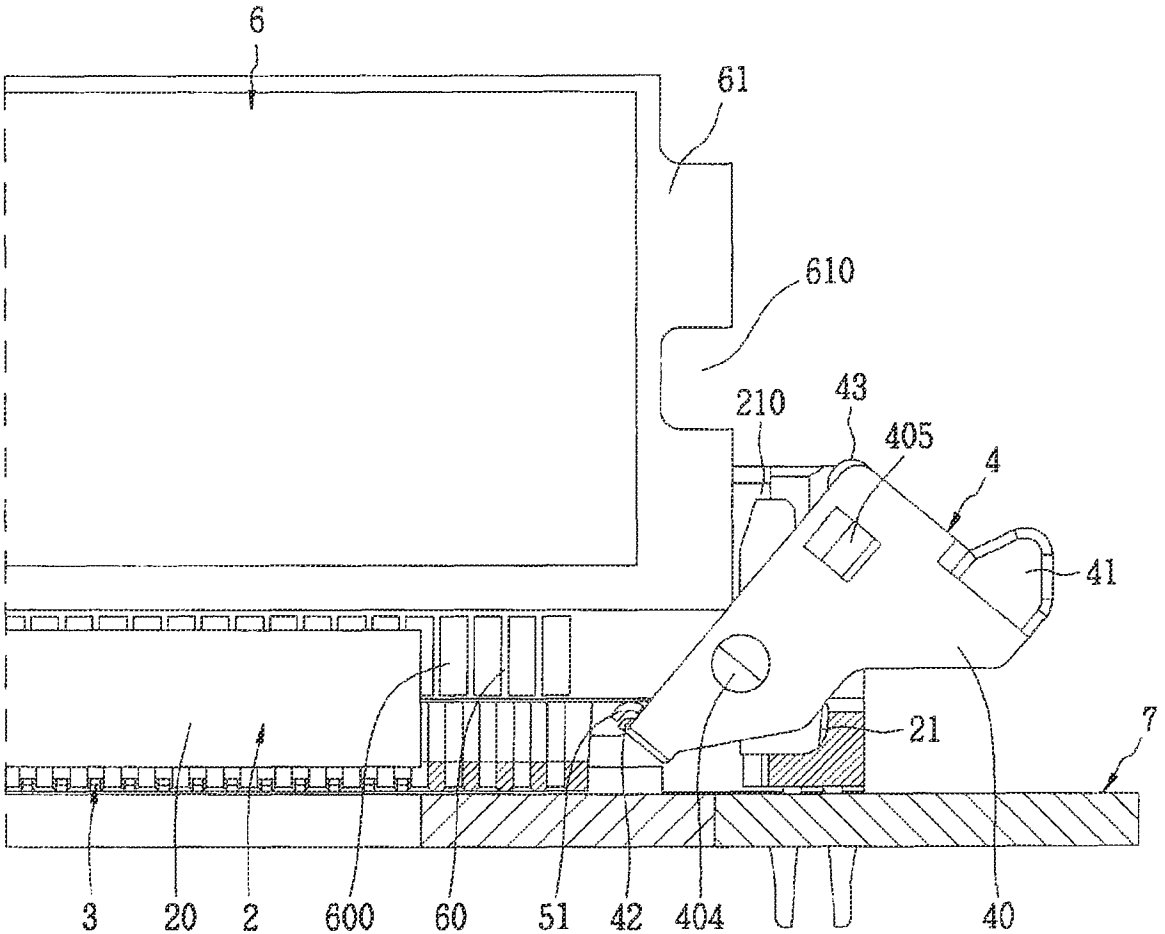
FIG. 8 is a side view of FIG. 7.
Figure 9:
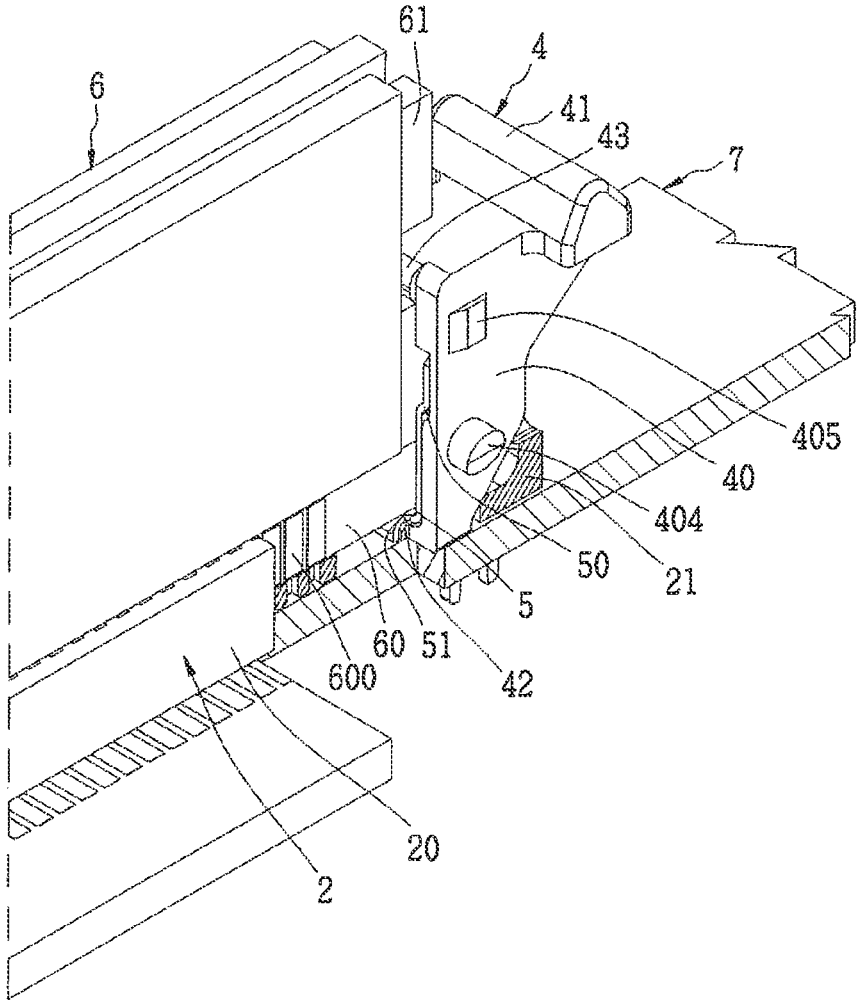
FIG. 9 is a partially cutaway three dimensional view of an embodiment of the card edge connector in the card locking position.
Figure 10:
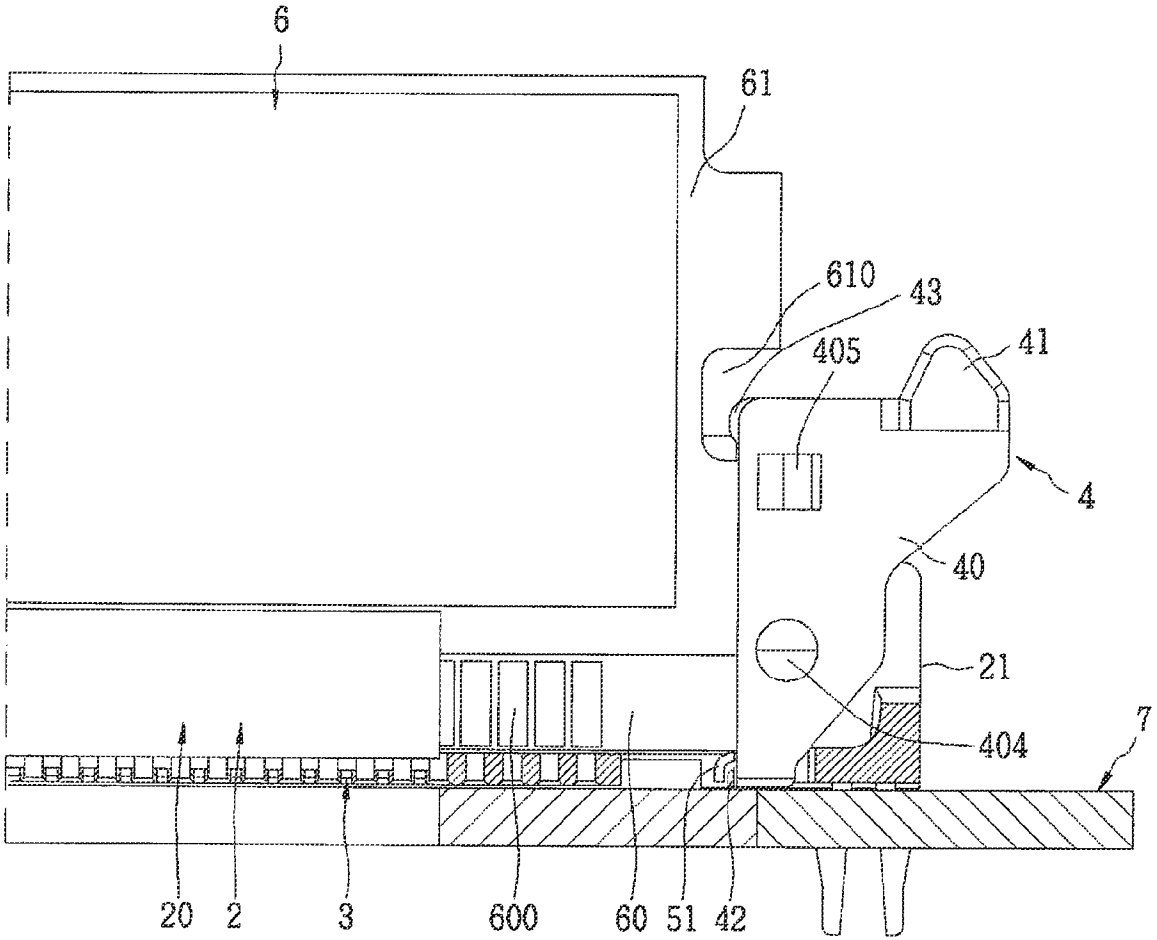
FIG. 10 is a side view of FIG. 9.

As shown in FIGS. 7 and 8, when the card-ejecting member 4 is in the card ejecting position, align the abutting-connection portion 60 of an electronic card 6 with the insertion slot 204 of the body 2 and insert it into the card edge connector 1. In the insertion process, the abutting-connection portion 60 of the electronic card 6 will press against the reinforcing portion 51 of the metal reinforcing member 5 on the locking sides 61, such that the card-ejecting member 4 changes from the card ejecting position to the card locking position as shown in FIGS. 9 and 10. At this point in the process the contact pads 600 on the electronic card 6 connect with the terminals 3 of the card edge connector 1, while the locking portion 43 is locked on the locking notch 610 of the locking side 61 of the electronic card 6 and cannot move up or down. As can be appreciated, the two opposing sidewalls 400 of the main body 40 clamp a part of corresponding locking sides 61 of the electronic card 6 inside the corresponding open slot 402 for further limiting movement of the electronic card 6. When ejecting the card, press the operating portion 41 such that the fixed convex part 405 of the card-ejecting member 4 overcomes the obstruction by the stop portion 215 on the installation portion 21, and changes from the card locking position as shown in FIGS. 9 and 10 to the card ejecting position as shown in FIGS. 7 and 8 so as to eject the electronic card 6, during the card ejecting process, the reinforcing portion 51 of the metal reinforcing member 5 will push against the abutting-connection portion 60 of the electronic card 6 so as to eject it out of the card edge connector 1.

Figure 1:
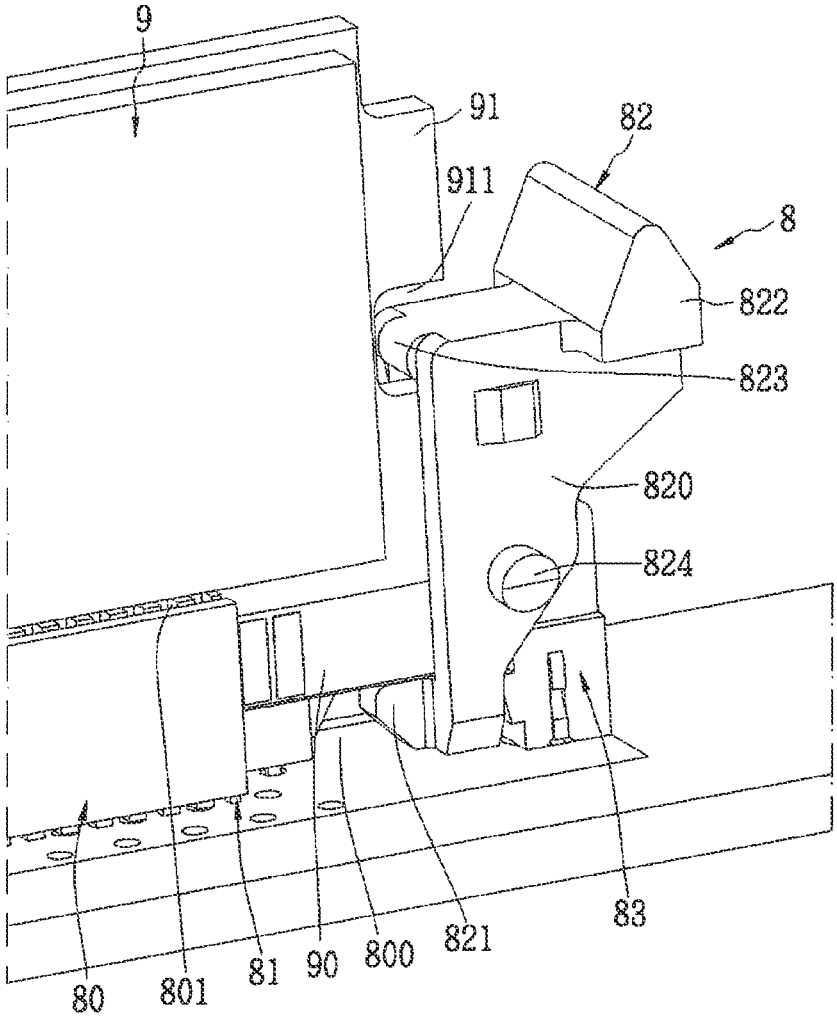
FIG. 1 is a partial view of a card edge connector in connection with a matching electronic card according to the prior art.

It can be seen that in the entire process of inserting, connecting and ejecting the electronic card 6, the electronic card 6 directly acts on the reinforcing portion 51 of the metal reinforcing member 5, and does not directly act on the ejecting portion 42 of the card-ejecting member 4. In such a way, the force to be borne by the ejecting portion 42 is significantly reduced and breakage can be avoided. Thus, the combination of the metal reinforcing member 5 and the ejecting portion 42 of the card-ejecting member 4 increases the bearing capacity. Furthermore, the extension portions on the inner sides of the sidewalls 400 can increase the strength of the sidewalls 400, thereby improving the strength of the entire card-ejecting member 4. Compared with the prior art card edge connector of FIG. 1, the card edge connector 1 has a stable quality even when miniaturized.

The above discussion is regarding exemplary embodiments and unless otherwise noted is not intended to limit the scope of present invention. Those skilled in the art may choose appropriate embodiments according to actual needs. In other embodiments, for example, there may be only one of the card-ejecting member 4 that is disposed on one end of the body 2, instead of a pair as set forth in the above embodiment. The fixing portion 50 of the metal reinforcing member 5 may be fixed to the card-ejecting member 4 by a variety of means, for example, both the first fixing portion 500 and the second fixing portion 501 are fixed through interference by means of lugs or fixed through interference by means of barbs, or the metal reinforcing member 5 is embedded into the card-ejecting member 4 and formed therewith integrally. In a different embodiment, the reinforcing portion 51 of the metal reinforcing member 5 may be disposed on the bottom face of the ejecting portion 42 of the card-ejecting member 4 or embedded inside the ejecting portion 42.

Technical contents and technical features of the present invention have been disclosed above. However, those skilled in the art may make various substitutions and modifications based on the teaching and disclosure hereof without departing from the spirit of the disclosure. Therefore, the protection scope of the present invention shall not be limited to the content disclosed by the embodiments, but shall include all substitutions and modifications encompassed by the claims hereof.

I claim:

1. A card edge connector, comprising:

a body including a base portion having two ends and an insertion slot extending therebetween, the insertion slot having a bottom and an installation portion disposed on one of the two ends;

a plurality of terminals supported by the body, and a card-ejecting member installed on the body, the card-ejecting member including a main body with a lower end, the main body being pivotably disposed on the installation portion and an ejecting portion disposed on the lower end, the ejection portion opposing the bottom of the insertion slot; and a metal reinforcing member disposed on the ejecting portion of the card-ejecting member.

2. The card edge connector as set forth in claim 1, wherein the ejecting portion has a top surface and the metal reinforcing member includes a reinforcing portion covering the top surface.

3. The card edge connector as set forth in claim 2, wherein the reinforcing portion has a round and smooth curved portion on the end thereof facing the insertion slot.

4. The card edge connector as set forth in claim 3, wherein the metal reinforcing member includes a fixing portion connected to the reinforcing portion and the fixing portion is fixedly held to the main body.

5. The card edge connector as set forth in claim 4, wherein the main body further comprises two opposing sidewalls and an open slot formed between the two opposing sidewalls, the fixing portion further comprises extension portions that extend from two sides of the reinforcing portion and a first fixing portion and a second fixing portion that are connected to each extension portion, respectively, and extend in a wing shape; the first fixing portion and the second fixing portion are fixed onto the two opposing sidewalls of the main body, respectively.

6. The card edge connector as set forth in claim 5, wherein insertion slots are formed on the inner sides of the two opposing sidewalls of the main body that are corresponding to the first fixing portion and the second fixing portion with the two extension portions disposed on the inner sides of the sidewalls, respectively.

7. The card edge connector as set forth in claim 6, wherein at least one of the first fixing portion and the second fixing portion is provided with a barb for interference fit with corresponding insertion slots.

8. The card edge connector as set forth in claim 7, wherein at least one of the first fixing portion and the second fixing portion is provided with a lug for fixing with a corresponding insertion slot.

9. The card edge connector as set forth in claim 4, wherein the main body has a first pair of opposing sidewalls and the installation portion is provided with a receiving space open to the insertion slot, the receiving space having a second pair of opposing sidewalls, wherein the first pair of opposing sidewalls are provided with a pivot, and the second pair of opposing sidewalls are provided with a pivoting hole for receiving corresponding pivots.

10. The card edge connector as set forth in claim 9, wherein the card-ejecting member is provided with a locking portion on a top end of the main body relative to the ejecting portion and further provided with an operating portion at the top end extended with the locking portion.

* * * * *